United States Patent [19]

Boyadjieff

[11] 4,346,631

[45] Aug. 31, 1982

[54] WELL PIPE SPINNING AND TORQUEING APPARATUS

[75] Inventor: George I. Boyadjieff, Anaheim, Calif.

[73] Assignee: Varco International, Inc., Orange, Calif.

[21] Appl. No.: 187,702

[22] Filed: Sep. 16, 1980

[51] Int. Cl.[3] ..... B25B 13/50

[52] U.S. Cl. ..... 81/57.34; 81/57.39

[58] Field of Search ..... 81/57.34, 57.33, 57.36, 81/57.39, 57.46; 173/147, 152, 164; 166/77.5, 85

[56] References Cited

U.S. PATENT DOCUMENTS

| | | | |
|---|---|---|---|
| 1,615,695 | 1/1927 | Grattan | 166/77.5 |
| 1,736,009 | 11/1979 | Nixon | 81/57.34 |
| 1,826,760 | 10/1931 | Foster . | |
| 2,089,800 | 10/1937 | Jones . | |
| 3,516,308 | 6/1970 | Ham et al. . | |
| 3,518,903 | 7/1970 | Ham et al. . | |
| 3,692,123 | 9/1972 | Gyongyosi | 173/147 |
| 4,253,354 | 3/1981 | Walker | 81/57.34 |

OTHER PUBLICATIONS

Drilco, "Ezy Torq" Hydraulic Cathead, 9-1-68, pp. 1-4.

Crews, S. T., Ezy Torq Hydraulic Cathead Insures High Make-Up Torques for Large Size Connections, Drilco, 4-15-69.

*Primary Examiner*—James L. Jones, Jr.

*Attorney, Agent, or Firm*—William P. Green

[57] ABSTRACT

A device for turning a section of well pipe to connect it to or disconnect it from a pipe string includes a power unit to be mounted at a side of a well and having a part, preferably a piston, which is power actuable in opposite directions, with that part acting upon movement in one direction to exert a pulling force on a flexible line connected to a tong for turning the pipe section, and with the specified part acting upon movement in the opposite direction to exert pulling force on a second elongated flexible element, preferably a chain, which extends about the pipe section and acts to spin it rotatably when the chain is pulled. The spinning element is desirably directed along a multiple reversing path giving that element increased longitudinal movement as compared with the tong actuating line for a predetermined length of movement of the piston, so that the spinning element can turn the pipe through a relatively large number of revolutions whereas the tong actuating line moves a shorter distance but can apply a greater torque to the pipe.

14 Claims, 8 Drawing Figures

WELL PIPE SPINNING AND TORQUEING APPARATUS

BACKGROUND OF THE INVENTION

This invention relates to improved well tools for use in spinning and applying torque to a section of well pipe in connecting it to or disconnecting it from the upper end of a pipe string in a well.

In adding a length of pipe to the upper end of a drill string, or disconnecting a section of pipe from the string, a conventional way of turning one pipe section relative to another is by power derived from a winch or 'cathead' of the draw works. The major portion of the rotary motion may be effected by a spinning operation in which a chain wound about a section of the pipe is pulled by the cathead to rapidly spin it. A final torqueing operation or initial joint breaking operation may be effected by a tong pulled by a line wound about the cathead. In lieu of this cathead actuated arrangement, more sophisticated rigs sometimes employ power spinners and torque wrenches which are receivable about the pipe and are adapted to more automatically perform the connecting and disconnecting operations. When such apparatus is employed, the draw works may not include a rotary cathead and consequently if the more sophisticated and automatic equipment becomes inoperative for any reason there may be no back up method of spinning and torqueing the pipe.

In addition to the above discussed types of devices for use in connecting and disconnecting well pipe, there has also been employed in the past a torqueing tool including a power cylinder mounted at a side of a wall and having a piston which acts upon movement relative to the cylinder to exert a pulling force on a line connected to a tong, to thus apply torque to a pipe about which the tong is received. The piston in that prior arrangement carries a sheave about which the pulling lines extends to cause the desired longitudinal displacement of the line in response to piston movement.

SUMMARY OF THE INVENTION

An object of the present invention is to provide a device which can perform both a spinning and torqueing operation on a well pipe and does so with an extremely simple structure of relatively low cost. It is contemplated that this tool may be employed as a back up device for a more complex automatic mechanism, or in inexpensive rigs may be employed as the primary spinning and torqueing apparatus. The device is especially useful where the draw works of a rig may not include a conventional rotary cathead, and has the advantage over such a cathead of enabling a more precise control and regulation of the torqueing and spinning forces A device embodying the invention includes a power unit which is mounted at a side of the well axis and has a part which is power actuable in opposite directions along a predetermined path. The power unit is preferably fluid actuated, desirably being a piston and cylinder mechanism in which the mentioned movable part is the piston of the unit. The device includes two elongated flexible elements, with the piston or other movable part acting to exert a pulling force on one of these elongated elements upon movement of the piston in a first direction, and to exert pulling force on the other of the two elongated elements upon movement of the piston in the opposite direction. One of the elongated elements is a line connectable to a tong to apply torqueing force thereto, while the second elongated flexible element may be a chain or the like adapted to extend about a pipe section and spin it as the chain is pulled. The two elongated elements are directed along paths, preferably defined by sheaves about which the elements extend, in a relation causing the spinning chain or element to move through a greater longitudinal distance for a predetermined length of movement of the piston than does the torqueing line connected to the tong, to thus apply a relatively great force to the tong and a reduced force but increased range of movement to the spinning chain.

BRIEF DESCRIPTION OF THE DRAWINGS

The above and other features and objects of the invention will be better understood from the following detailed description of the typical embodiment illustrated in the accompanying drawings in which.

DESCRIPTION OF THE PREFERRED EMBODIMENT

Figure 1:
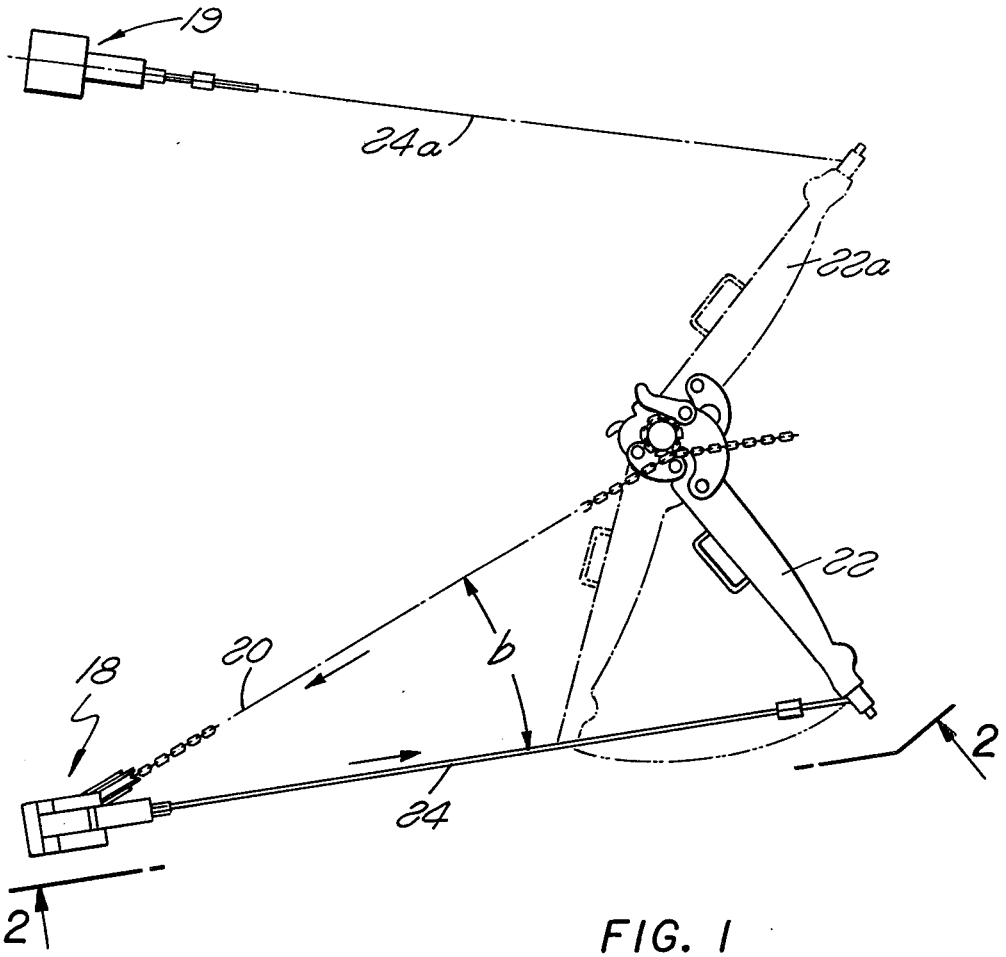
FIG. 1 is a plan view of a well drilling rig provided with spinning and torqueing equipment embodying the present invention.
Figure 2:
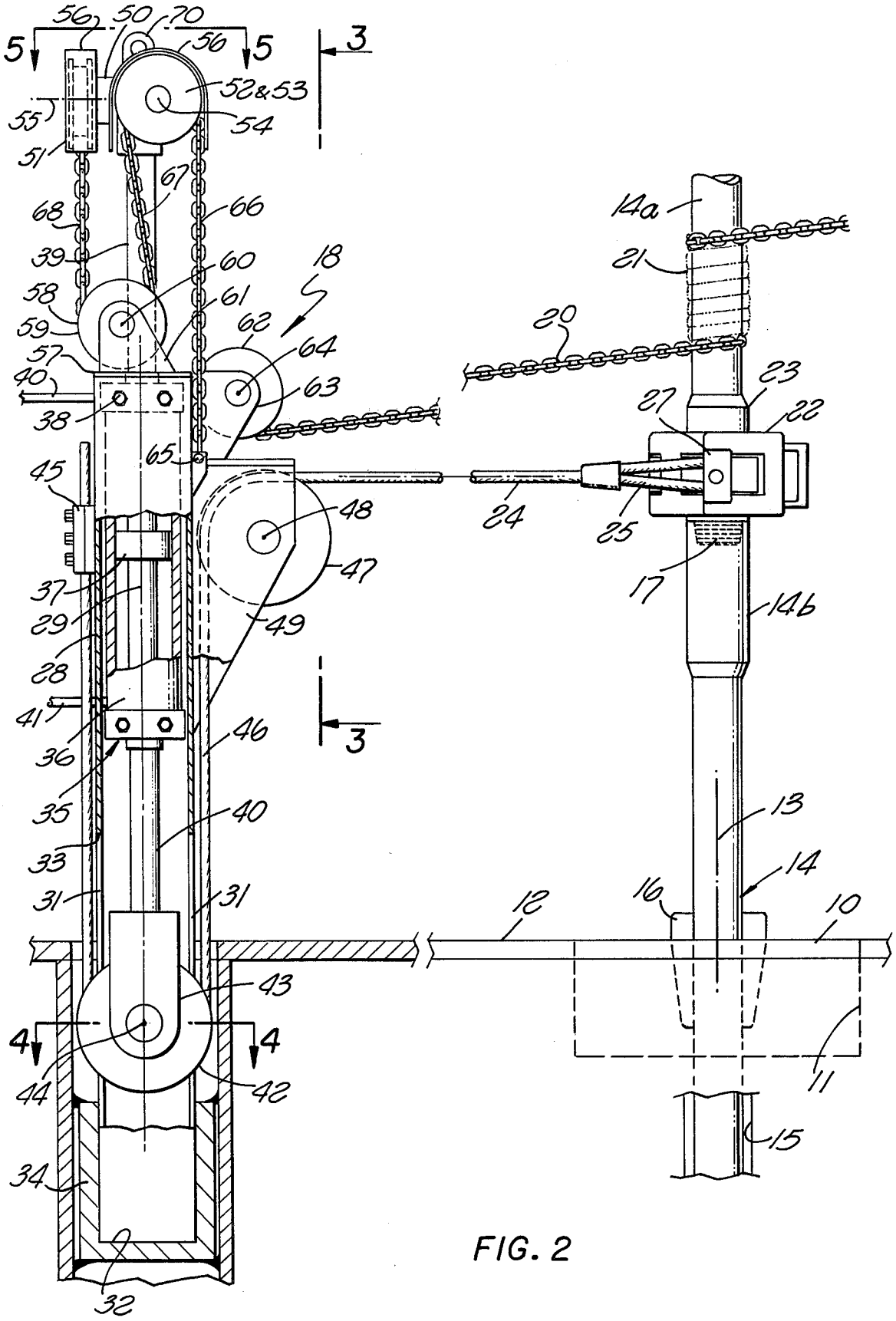
FIG. 2 is a side view of the combined spinning and torqueing cathead taken on line 2—2 of FIG. 1.
Figure 3:
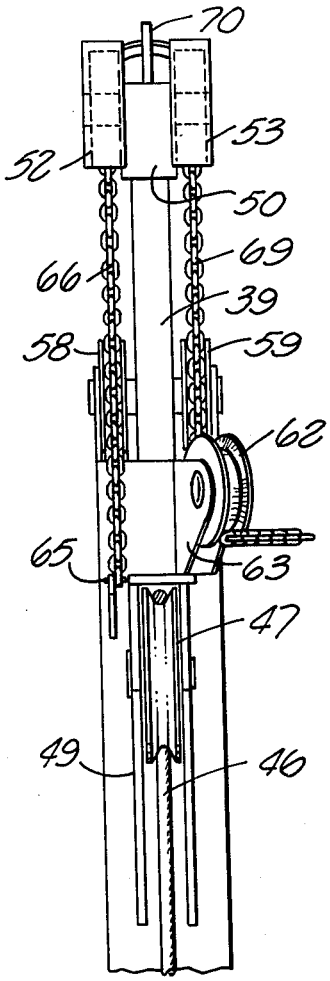
FIG. 3 is a fragmentary view taken on line 3—3 of FIG. 2.

The well drilling rig illustrated fragmentarily in FIGS. 1 and 2 includes a rotary table 10 mounted in an opening 11 in a rig floor 12 and adapted to drive rotatably about a vertical axis 13 a string of well pipe 14 for drilling a well bore 15. The drill pipe can be supported in the rotary table by the usual slips 16. Two sections of the drill pipe which are to be connected together or disconnected by apparatus embodying the invention are represented at **14*a* and 14*b*, and have threads interengaging at 17**.

The apparatus of the present invention for connecting and disconnecting sections **14*a* and 14*b* includes a first spinning and torqueing device 18 for use in making threaded connections between the pipe sections, and a second device 19 for use in disconnecting the pipe sections. The device 18 spins the upper section 14*a* about axis 13 in a righthand or connecting direction by exerting pulling force (leftwardly in FIGS. 1 and 2) on a chain 20 which is wrapped several times about the pipe 14*a* at 21. An increased torque for the final makeup action is exerted against pipe 14*a* by a conventional tong 22 which grips the enlarged joint end 23 of upper pipe section 14*a* and applies a righthand connecting torque to it. This tong 22 is actuated by device 18 through exertion of a pulling force on a cable 24 attached to the end of the tong. Cable 24 may have a loop 25 formed at its end and received about the arm of the tong at 26, with an enlarged head 27** on the tong arm acting to prevent accidental detachment of the cable from the tong.

The device 18 may be considered as performing the function of a cathead, for pulling the elongated flexible elements 20 and 24. This cathead is illustrated as including a hollow vertical support column 28 which projects upwardly above the rig floor 12 along a vertical axis 29 parallel to the axis 13 of the well. Column 28 may be formed as a non-circular vertical tube, typically of the square horizontal cross-section illustrated in FIG. 4, with that cross-section being uniform along the entire vertical extent of the tube except as interrupted by two diametrically opposed vertical slits 30 formed in two opposite side walls 31 of the tube. These slits 30 may extend from the lower extremity 32 of column 28 to a location 33.

The column 28 may be mounted to the floor structure 12 in any convenient manner, as by welding or bolting it to the floor or the rig substructure or as typically illustrated in FIG. 2 by inserting the lower end of column 28 downwardly into a pocket 34 defining a recess of a square cross-section corresponding to column 28 and closely receiving and confining the column in a manner rigidly locating it in the upstanding position illustrated in FIG. 2. The pocket structure 34 may be secured in any appropriate manner to the rig floor 12.

Contained within the upper portion of hollow vertical column 28, there is provided a hydraulic piston and cylinder mechanism 35, including a power cylinder 36 containing a double acting piston 37 movable upwardly and downwardly relative to the cylinder along vertical axis 29. Cylinder 36 is secured rigidly to column 28, as by bolts or other fasteners represented at 38. The piston 37 carries an upwardly projecting rod 39 and a downwardly projecting rod 40, aligned with one another and extending along vertical axis 29. Pressurized hydraulic fluid is admitted to and discharged from the upper chamber in cylinder 36, above piston 37, through a line 40, and is admitted to and discharged from the lower chamber beneath piston 37 through a line 41, to thus power actuate the piston and its connected rods both upwardly and downwardly.

Figure 4:
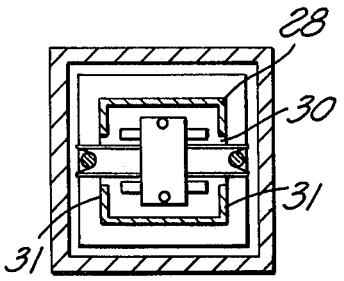
FIG. 4 is an enlarged horizontal section taken on line 4—4 of FIG. 2.
Figure 5:
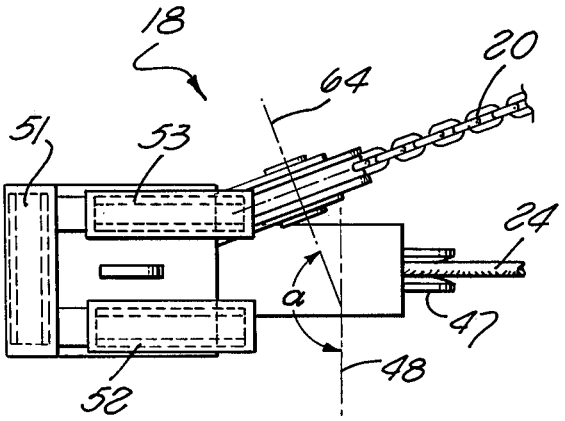
FIG. 5 is an enlarged plan view taken on line 5—5 of FIG. 2.

The downwardly projecting piston rod 40 rotatably carries a sheave 42, which is mounted by a bifurcated end fitting 43 on the rod to rotate relative to the rod about an axis 44 extending horizontally and perpendicular to and intersecting vertical axis 29. As seen in FIG. 4, the sheave 42 is positioned for reception of diametrically opposed portions thereof within the two vertical slots 30 in column 28. Cable 24 has its second end fixed rigidly to column 28, by a clamping element 45, and from that clamp 45 extends downwardly along the left-hand side of column 28 as viewed in FIG. 2 and then about the underside of sheave 42 and upwardly at 46 along the right side of the column. The cable 24 then extends about a sheave 47 which is mounted to rotate relative to the column about a horizontal axis 48. This mounting of the sheave 47 may be effected by providing two parallel walls 49 welded to column 28 and projecting rightwardly therefrom as viewed in FIG. 2, with the sheave 47 being received between these walls. From sheave 47, the cable 24 extends rightwardly to its point of connection to tong 22.

The upwardly projecting rod 39 of piston 37 carries a head 50 at the top of the rod, to which head three sheaves 51, 52 and 53 are rotatably mounted. Sheaves 52 and 53 turn about a common axis 54 extending horizontally and parallel to axes 44 and 48, and offset slightly to the right of axis 29 as viewed in FIG. 2. The axis 55 of sheave 51 is also horizontal but perpendicular to and intersects axes 29 and 54. Chain 20 extends about all of these sheaves, and is retained against displacement from the peripheral grooves of the sheaves by arcuate shrouds 56 extending about the upper sides of the sheaves.

A horizontal wall 57 extends across the top of column 28, and mounts two additional sheaves 58 and 59, which turn about a common horizontal axis 60 disposed parallel to axes 44, 48 and 54 and offset slightly to the left of axis 29 as viewed in FIG. 2. The sheaves 58 and 59 are mounted by bifurcated brackets 61 welded or otherwise secured to the top wall of the column. An additional sheave 62 is mounted rotatably between a pair of spaced parallel walls 63 which are welded or otherwise rigidly secured to column 28 and project rightwardly therefrom as viewed in FIGS. 1 and 2, with these walls being disposed at an angle as seen in FIG. 1 so that the axis 64 of sheave 62 is disposed horizontally and at an oblique angle a with respect to a vertical plane containing axis 48 of sheave 47 (see FIG. 1), to direct chain 20 at an angle b with respect to cable 24 as seen in the plan view.

The inner end of chain 20 is secured at 65 to column 28, and from that point of attachment extends first upwardly at 66 then about the upper side of sheave 52, then downwardly at 67 and about the underside of sheave 58, then upwardly at 68 and about the upper side of sheave 51, then downwardly and about the underside of sheave 59, then upwardly and about the upper side of sheave 53, then downwardly at 69 and about the underside of sheave 62, and then extends generally horizontally to the location of pipe section **14*a*. The head 50 at the upper end of rod 39 may have an eye 70 for engagement with a hoisting line to lift the device 18 out of or lower it into pocket 34**.

Figure 7:
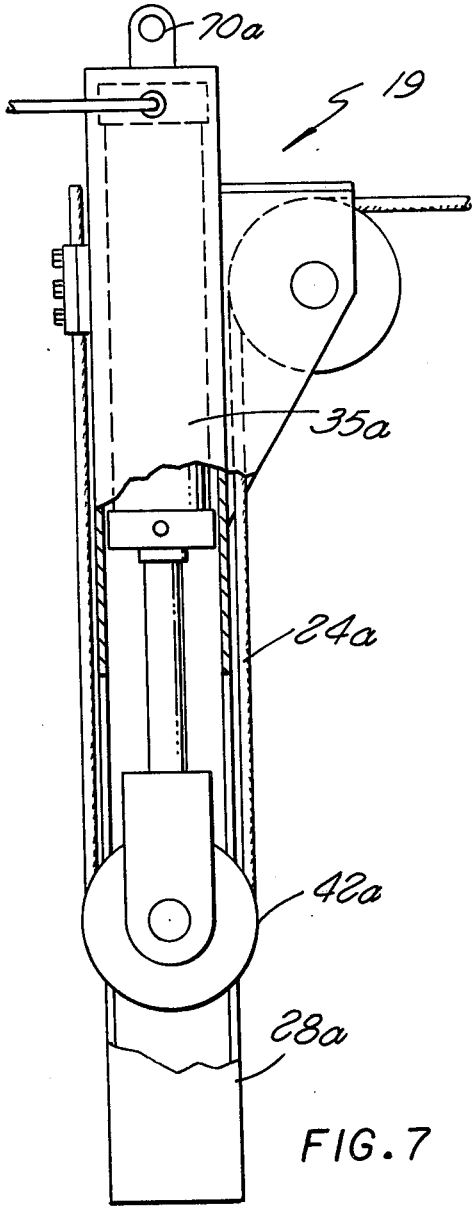
FIG. 7 is a view taken on line 7—7 of FIG. 1 and showing the breakout cathead device.
Figure 6:
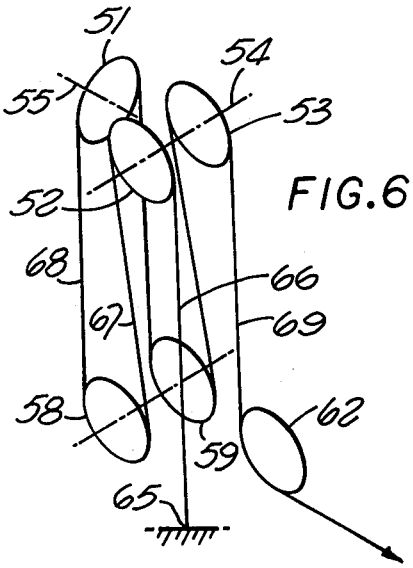
FIG. 6 is a diagrammatic representation of the rigging of the chain in FIGS. 1 to 5.

The device 19 of FIG. 1 is similar to the above described unit 18, except that the device 19 does not have the spinning chain 20 and its associated parts. The unit 19 does include a column **28*a* receivable within a mounting pocket such as that shown at 34 in FIG. 2 and containing a piston and cylinder mechanism 35*a* having a downwardly projecting rod carrying a sheave 42*a* which actuates a cable 24*a* to pull a tong 22*a*. This tong is used to turn the upper pipe section 14*a* in a counterclockwise or unscrewing direction. The piston and cylinder mechanism of the device 19 in FIG. 7 does not have an upwardly projecting rod corresponding to that shown at 39 in FIG. 2. Column 28*a* may have an eye 70*a* at its upper end for lifting the device 19** out of its receiving pocket or lowering it thereinto.

Figure 8:
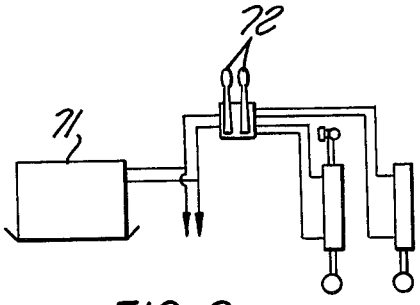
FIG. 8 is a diagrammatic representation of the hydraulic control system for the overall assembly.

FIG. 8 represents the hydraulic system for the apparatus of FIGS. 1 to 7, which system includes a source 71 of hydraulic fluid under pressure delivering pressurized fluid to and discharging it from the opposite ends of the two units 18 and 19 under the control of valve means represented at 72.

To describe now the use of the unit 18 in connecting the upper pipe section **14*a* of FIG. 2 to the second pipe section 14*b*, the first step is to lower section 14*a* to a position directly above and essentially contacting section 14*b*. With piston 37 in its lowermost position, chain 20 is then wrapped about section 14*a* as illustrated in FIG. 2. The tong 22 may at this stage be placed about the enlarged joint end 23 of pipe section 14*a*, and be connected to cable 24, which in the lowermost position of the piston is pulled inwardly to locate the tong in the broken line position of FIG. 1. The driller may then actuate valve means 72 to supply pressure fluid from source 71 to the lower end of cylinder 36, to force piston 37 upwardly. The resultant upward movement of head 50 at the upper end of piston rod 39 causes sheaves 51, 52 and 53 to move upwardly relative to sheaves 58, 59 and 62 in a manner pulling the chain rapidly leftwardly as viewed in FIG. 2 and thereby rapidly spinning the upper pipe section 14***a* in a righthand connecting direction to screw its lower pin end into the box end of section 14*b* at 17. At the same time, the upward movement of lower sheave 42 with the piston enables cable 24 to be pulled rightwardly as viewed in FIG. 2, so that an operator may swing tong 22 from the broken line position of FIG. 1 to the full line position of that figure in preparation for a torqueing operation. The vertical movement of piston 37 is great enough to pull chain 20 entirely off of pipe section 14*a*, so that the chain will not interfere with subsequent actuation of the tong by device 18. After the piston has reached its uppermost position, the valves are reversed to cause downward movement of the piston relative to cylinder 36, thereby exerting a leftward pulling force on cable 24 actuating tong 22 from its full line position of FIG. 1 to its broken line position to apply a controlled righthand torque to section 14*a* completing the connection between parts 14*a* and 14*b*. At the same time, the downward movement of the piston enables chain 20 to be pulled rightwardly in preparation for the next successive spinning operation.

Because the cable 24 extends first downwardly to sheave 42 and then upwardly from that sheave to sheave 47, the longitudinal movement of the portion of cable 24 which is connected to tong 22 is twice as great as the axial movement of piston 37 for any particular actuation of the parts. The longitudinal movement of the portion of chain 20 which extends rightwardly to the pipe in FIG. 2 is amplified even more relative to the piston movement and relative to the cable movement by virtue of the extension of the chain upwardly and downwardly several times between the two sets of sheaves carried by the piston rod 39 and column 29. For a particular length of piston movement, the longitudinal movement of the portion of the chain extending toward the pipe is greater than the longitudinal movement of the portion of the cable extending toward the tong, and in the particular arrangement illustrated is three times as great as the cable movement. The chain can thus spin the pipe through several turns at low torque whereas the cable turns the pipe through a relatively small angle at much greater torque. This effect is further enhanced by the fact that the cable is connected to the tong at a much greater radial distance from the axis of the pipe than that at which the chain contacts the outer surface of the pipe.

When it is desired to break the connection between two pipe sections such as those illustrated at 14*a* and 14*b* in FIG. 2, this result is achieved by use of the second of the devices 19, whose cable 24*a* is connected to tong 22*a* in the same manner discussed in connection with cable 24 and tong 22 of the device 18, so that upon downward actuation of the piston of mechanism 35*a* of device 19 the cable exerts a pulling force on tong 22*a* and applies a torque to the pipe breaking the threaded connection between sections 14*a* and 14*b*. The spinning chain is not necessary in this instance, since rotary table 10 may then be actuated to turn pipe section 14*b* (suspended in the table by slips 16) in a clockwise direction rapidly unscrewing section 14*a* from section 14*b*. During this spinning operation, the upper section 14*a* is retained against movement with lower section 14*b* by tong 22*a*.

While a certain specific embodiment of the present invention has been disclosed as typical, the invention is of course not limited to this particular form, but rather is applicable broadly to all such variations as fall within the scope of the appended claims.

I claim:

1. Well pipe spinning and torqueing apparatus comprising:

a power unit including a first section and including a second section which is power actuable along an axis relative to the first section and moves in opposite directions along said axis;

a first elongated flexible element adapted to be connected to a pipe gripping tong and connected to said movable second section of said power unit in a relation exerting a pulling force on said element and the tong upon movement of said second section of the power unit in one of said direction; and a second elongated flexible element adapted to be wrapped about and spin a well pipe and connected to said movable second section of the power unit in a relation exerting a pulling force on said second element to spin the pipe upon movement of said second section of the power unit in the other of said directions.

2. Apparatus as recited in claim 1, in which said second section of the power unit is actuated along said axis relative to said first section by fluid pressure.

3. Apparatus as recited in claim 1, in which one of said sections of the power unit is a cylinder and the other section is a piston.

4. Apparatus as recited in claim 1, in which said first section of said power unit is a cylinder, and said second section is a piston, there being means for admitting pressure fluid into the cylinder at opposite sides of said piston to power actuate it in each of said opposite directions.

5. Apparatus as recited in claim 1, in which said first section of said power unit is a cylinder, and said second section is a piston having rods projecting in opposite directions and operatively connected to said two flexible elements respectively.

6. Apparatus as recited in claim 1, including means directing said second flexible element along a path giving the second flexible element greater longitudinal movement than the first elongated flexible element for a predetermined length of movement of said second section of the power unit.

7. Apparatus as recited in claim 1, including two sets of sheaves associated with said two sections respectively of said power unit and directing said second elongated flexible element along a path acting to give said second element greater longitudinal movement than said first element for a predetermined length of displacement of said second section of the power unit.

8. Apparatus as recited in claim 1, including a first sheave movable with said second section of the power unit and about which said first elongated flexible element extends in a relation exerting a pulling force on said first element upon movement of said first section in said one direction, and a plurality of sheaves movable with said second section of the power unit and about which said second elongated element extends in a relation causing greater longitudinal movement of said second element than of said first element for a predetermined length of displacement of the second section of the power unit.

9. Well pipe spinning and torqueing apparatus comprising:

a support column to be mounted at the side of a well pipe;

a fluid pressure actuated power unit including a cylinder fixed to said support column and a double acting piston actuable upwardly and downwardly by fluid pressure and having an upwardly projecting rod and downwardly projecting rod movable with the piston;

a first sheave carried by one of said rods and actuable vertically therewith;

a first elongated flexible element fixed at one end relative to said support column and adapted to be connected at its opposite end to a tong and extending about said sheave in a relation exerting a pulling force on said flexible element and a connected tong upon movement of the piston and rods in one axial direction;

a first set of additional sheaves carried by and movable with a second of said piston rods;

a second set of additional sheaves fixed with respect to said support column; and a second elongated flexible element fixed at a first end with respect to said support column and having a second end portion adapted to extend about and spin a well pipe, and which is threaded along a multiple reversing path extending about the sheaves of said first and second sets of additional sheaves alternately in a relation exerting a pulling force on said second elongated element upon movement of the piston and rods in a second axial direction the opposite of said one direction, and causing greater longitudinal movement of said second elongated element than of said first elongated element for a predetermined length of movement of the piston and rods.

10. Apparatus as recited in claim 9, in which said support column is hollow and contains said cylinder and said downwardly projecting rod, with said first sheave being carried by said downwardly projecting rod.

11. Apparatus as recited in claim 9, in which said support column has vertical slits at opposite sides thereof, and said first elongated element extends downwardly at one side of the column and through said slits and about the underside of said first sheave and then upwardly at the opposite side of said column, there being another sheave carried at said opposite side of said column and about which said first elongated element then extends to advance generally horizontally therefrom to a tong.

12. Apparatus as recited in claim 1, including a well pipe about which said second elongated flexible element extends to spin the pipe upon longitudinal movement of said second element, and a tong connected to said first elongated flexible element for torqueing the pipe.

13. The combination comprising two cathead devices mounted at spaced locations near a well pipe and each including a power actuated part movable in opposite axial directions;

a first of said devices having a torqueing line connectable to a first tong to torque a well pipe in a first rotary direction upon axial movement of said part of said first device;

said second device having a first elongated flexible element connectable to a second tong to torque a well pipe in the opposite rotary direction upon movement of said part of said second device in a first axial direction; and said second device including a second elongated flexible element adapted to be wrapped about and spin a well pipe in said opposite rotary direction upon movement of said part of said second device in the second axial direction.

14. Apparatus as recited in claim 13, including means directing said second flexible element along a path acting to produce greater longitudinal movement of it than of said first elongated flexible element for a predetermined length of displacement of said part of said second device.

* * * * *